US006749284B2

(12) United States Patent
Nagoshi et al.

(10) Patent No.: US 6,749,284 B2
(45) Date of Patent: Jun. 15, 2004

(54) IMAGE PROCESSING METHOD, PRINTING SYSTEM AND PRINTING APPARATUS

(75) Inventors: Shigeyasu Nagoshi, Kanagawa (JP); Okinori Tsuchiya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/207,891

(22) Filed: Jul. 31, 2002

(65) Prior Publication Data

US 2003/0025759 A1 Feb. 6, 2003

(30) Foreign Application Priority Data

Aug. 1, 2001 (JP) ..... 2001/233926

(51) Int. Cl.[7] ..... B41J 2/21
(52) U.S. Cl. ..... 347/43; 347/41; 347/15
(58) Field of Search ..... 347/15, 43, 41, 347/16, 37; 358/1.2, 1.9

(56) References Cited

U.S. PATENT DOCUMENTS 5,795,082 A 8/1998 Shimada et al. ..... 400/120.09
5,988,791 A 11/1999 Miyashita et al. ..... 347/43

*Primary Examiner*—Lamson Nguyen
(74) *Attorney, Agent, or Firm*—Fitzpatrick, Cella, Harper & Scinto

(57) ABSTRACT

When a printing apparatus performs printing using dark and light inks, a large variation in density caused by a rapid decrease in ink applying rate is prevented, thereby enabling proper density reproduction. More specifically, when for example, green hues of different densities are printed, light cyan ink is used between points corresponding to a variation of color from white to green. Furthermore, after the maximum saturation point, light cyan ink is used in addition to the dark cyan ink. This prevents the total applying rate from decreasing rapidly near the maximum eaturation point.

36 Claims, 7 Drawing Sheets

IMAGE PROCESSING METHOD, PRINTING SYSTEM AND PRINTING APPARATUS

This application is based on Patent Application No. 2001-233926 filed Aug. 1, 2001 in Japan, the content of which is incorporated hereinto by reference.

BACKGROUND OF THE INVENTION

1. Field of the Invention

The present invention relates to an image processing method, a printing system and a printing apparatus, and more specifically, to a density reproduction in printing performed by using printing agents of same base color or same hue, which are different in a concentration of a coloring material included therein.

2. Description of the Related Art

Ink jet printers are known as one of the most widely used printing apparatuses. Many of such widely used printing apparatuses have recently used printing agents of different coloring material densities for the same base color or hue. For example, an ink jet printer not only uses cyan, magenta, yellow, and black inks but also uses, for cyan and magenta, light color ink composed of coloring material such as a dye or pigment having a lower concentration. This improves image quality by, for example, reducing the granularity of ink dots in a low-density portion of a printed image.

A printer of this kind performs printing using, for example, a total of six types of inks including dark and light cyan inks, dark and light magenta inks, and yellow and black inks, as described above. Accordingly, a plurality of inks are often used to represent one color, then an ink applying rate, which is an amount of ink ejected per unit area of a printing sheet, tends to be close to its maximum value determined considering the ink absorbency of the printing sheet and the like.

FIG. 1 is a diagram illustrating the applying rate of ink. More specifically, this figure shows an ink dot arrangement pattern (also referred to as an "index pattern") for data on density of one color for each pixel which data are transmitted by a host apparatus such as personal computer. More specifically, the host apparatus transmits any of the nine data "0" to "8" to the printer as index data representative of the density of the pixel. The printer then forms ink dots in a pattern according to this index. Thus, the printer can achieve printing at a resolution higher than that represented by the index data.

In the figure, circles denoted by signs a and b each represent one dot composed of one ink droplet. The circles a and b both indicate ink droplets but are denoted using the different patterns for the convenience of illustration. Further, the circles a and b are arranged so as to lie partially outside square frames. This is also for the convenience of illustration. Actually, ink is ejected so that the dots are formed within the square frame. The dots are formed within the frame or so as to lie slightly partially outside the frame depending on various errors in the printer.

In FIG. 1, the 2×2=4 squares shown for each of the index data "0" to "8" correspond to a print resolution for the printer, i.e. forming density of dots. This is achieved when, for example, the arrangement density of ejection openings in a printing head is the same as this dot forming density and when the frequency of ink ejecting operations performed at a certain scanning speed of the printing head is set according to this dot forming density.

The ink applying rate is said to be 100% when the printer forms one dot in the small square constituting the 2×2 square. On the other hand, on the host apparatus side, when the ink applying rate is defined on the basis of pixels corresponding to the respective index data, the ink applying rate is determined by the number of dots arranged in the 2×2 square for each index data shown in FIG. 1. In the following description, the ink applying rate refers to the value determined for each data corresponding to the pixels. More specifically, FIG. 1 shows an example that zero to eight ink droplets are caused to be applied on the printing sheet for each pixel in the host data, i.e. an example of index pattern formed in the case that the applying rate is 0% to 200%. In the figure, the index data "0" indicates white. In this case, the applying rate is 0%, and no dots are formed. With the index data "1", one dot is formed and the applying rate is 25%. With the index data "2", two dots are formed and the applying rate is 50%. This principle applies to the other cases, and with the index data "8", eight dots are formed and the applying rate is 200%.

The index pattern shown in FIG. 1 is used, for example, for each of the six types of inks described above. This enables printing using the respective inks.

FIG. 2 is a graph showing a conventional example of the ink applying rate described above. This graph shows the ink applying rate of ink used for colors obtained by varying signal values for green, each of which is one of the colors represented by combinations of signals R, G, and B, when the colors are represented using the above described six types of inks, as well as a total applying rate corresponding to the total of these applying rates.

In FIG. 2, the numbers on a horizontal axis denotes points which are obtained by dividing the range of variations in signal values into 32 portions, which range is of hue of green and varies from white through green to black depending on variations in R, G, B signal values. A vertical axis indicates the applying rates of ink used to represent colors with the respective signal values, as well as the total applying rate. The number 1 on the vertical axis corresponds to white (signal values: R=G=B=255), and no ink of any types is used. Then, as the signal values vary from white to green (as the number increases), the density of green is increased using first the yellow ink and the light cyan ink. Furthermore, at the density (number 12) at which the color cannot be represented with only the light cyan ink, the dark cyan ink starts to be used. Subsequently, the density is increased using the light and dark cyan inks and the yellow ink until the maximum saturation or maximum density of green (number 17; signal values: R=0, G=255, and B=0) are reached. Then, at this maximum saturation point, the use of the light cyan ink is stopped. This is because dark color ink has a higher density and a wider color reproduction range than light color ink. Then, in the range with which the color represented by the signal values vary from green to black, the saturation and lightness are reduced using the light magenta ink, which is complementary color to green. In a way of this range, similarly to the case of cyan-based ink, the dark magenta ink begins to be used in addition to the light magenta ink (number 22). Subsequently, the saturation and lightness are further reduced, and for this purpose the black ink is used to make the color closer to black (number 24). For the black corresponding to the number 33 (signal values: R=G=B=0), the black, dark cyan, dark magenta, and yellow inks are all used.

In the case of representing colors varying as described above, then in the illustrated example, the total applying rate is about 220%. The maximum applying rate is determined on the basis of the ink receiving capability and ink permeation property of a printing medium, a printing speed, and the like. That is, the illustrated example indicates that the printing medium can cope with a maximum applying rate of 220%.

As shown in FIG. 2, the total applying rate reaches its maximum value of 220% when the light cyan ink is ejected at the maximum applying rate (number 13). Further, the total applying rate decreases rapidly near the maximum saturation point or maximum density point. Subsequently, the total applying rate first increases with increasing of amount of complementary color components. Then, the applying rates of the dark cyan, dark magenta and yellow inks decrease because of an increase in amount of black ink, and thus the total applying rate correspondingly decreases.

However, with the above described conventional method of performing printing using dark and light color inks, the total ink applying rate may decrease rapidly in some range. Consequently, the printed image may have a portion that is not appropriately reproduced in density, such as partly decrease in the printed density.

More specifically, as shown in FIG. 2, the light cyan ink is used until the total applying rate reaches its maximum value. Then, the dark cyan ink starts to be used in addition to the light cyan ink, and once the maximum saturation or the maximum density point (number 17) is reached, only the dark cyan ink is used. As a result, the light and dark cyan inks are quickly switched within a relatively narrow range of signal values (from number 12 to number 17). Thus, the total applying rate, including the applying rate of the yellow ink, decreases rapidly. Such a decrease in the total applying rate reduces an area factor, which is a rate of the area of the printing medium covered with ink dots, of an area printed based on gradation value data of the corresponding range. As a result, the forming density of dots in this area may decrease compared to surrounding areas or the densities of the surrounding areas increase rapidly compared to this area. Therefore, the density may be partially inappropriately reproduced.

SUMMARY OF THE INVENTION

An object of the present invention is to provide an image processing apparatus and a printing system and apparatus that enable density to be appropriately reproduced for a printing operation that uses color materials of different densities for colors of similar shades.

In the first aspect of the present invention, there is provided an image processing method for generating printing data based on an image signal, the printing data being used for a printing apparatus that performs printing on a printing medium using, for same base color, a printing agent of a first coloring material concentration and a printing agent of a second coloring material concentration lower than the first color material concentration, wherein for a range of variations in image signal values corresponding to a variation of color from white, through a color having a maximum saturation or a maximum density of a predetermined color, to black, printing data are generated so that both the printing agent of the first coloring material concentration and the printing agent of the second coloring material concentration are used for the signal values of the color having the maximum saturation or the maximum density of the predetermined color.

In the second aspect of the present invention, there is provided an image processing method for generating printing data based on an image signal, the printing data being used for a printing apparatus that performs printing on a printing medium using, for same base color, a printing agent of a first coloring material concentration and a printing agent of a second coloring material concentration lower than the first color material concentration, wherein for a range of variation in image signal values, printing data are generated so that the distribution of an applying rate of the printing agent of the second coloring material concentration varies from a maximum value thereof to zero with 10 of 32 intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

In the third aspect of the present invention, there is provided an image processing method for generating printing data based on an image signal, the printing data being used for a printing apparatus that performs printing on a printing medium using, for same base color, a printing agent of a first coloring material concentration and a printing agent of a second coloring material concentration lower than the first color material concentration, wherein for a range of variations in image signal values, printing data are generated so that an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

In the fourth aspect of the present invention, there is provided a printing system including a printing apparatus that performs printing on a printing medium using, for same base color, a printing agent of a first coloring material concentration and a printing agent of a second coloring material concentration lower than the first color material concentration and an image processing apparatus for generating printing data used in the printing apparatus based on an image signal, wherein the image processing apparatus generates the printing data so that for a range of variations in image signal values corresponding to a variation of color from white, through a color having a maximum saturation or a maximum density of a predetermined color, to black, both the printing agent of the first coloring material concentration and the printing agent of the second coloring material concentration are used for the signal values of the color having the maximum saturation or the maximum density of the predetermined color.

In the fifth aspect of the present invention, there is provided a printing system including a printing apparatus that performs printing on a printing medium using, for same base color, a printing agent of a first coloring material concentration and a printing agent of a second coloring material concentration lower than the first color material concentration and an image processing apparatus for generating printing data used in the printing apparatus based on an image signal, wherein the image processing apparatus generates the printing data so that for a range of variation in image signal values, the distribution of an applying rate of the printing agent of the second coloring material concentration varies from a maximum value thereof to zero with 10 of 32 intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

In the sixth aspect of the present invention, there is provided a printing system including a printing apparatus that performs printing on a printing medium using, for same base color, a printing agent of a first coloring material concentration and a printing agent of a second coloring material concentration lower than the first color material concentration and an image processing apparatus for generating printing data used in the printing apparatus based on an image signal, wherein the image processing apparatus generates the printing data so that for a range of variations in image signal values, an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

In the seventh aspect of the present invention, there is provided a printing apparatus that performs printing on a printing medium using, for same base color, a printing agent of a first coloring material concentration and a printing agent of a second coloring material concentration lower than the first color material concentration, based on printing data generated based on an image signal, wherein based on the printing data generated for a range of variations in image signal values corresponding to a variation of color from white, through a color having a maximum saturation or a maximum density of a predetermined color, to black, both the printing agent of the first coloring material concentration and the printing agent of the second coloring material concentration are used for printing the color having the maximum saturation or the maximum density of the predetermined color.

In the eighth aspect of the present invention, there is provided a printing apparatus that performs printing on a printing medium using, for same base color, a printing agent of a first coloring material concentration and a printing agent of a second coloring material concentration lower than the first color material concentration, based on printing data generated based on an image signal, wherein for a range of variation in image signal values, printing is performed so that the distribution of an applying rate of the printing agent of the second coloring material concentration varies from a maximum value thereof to zero with 10 of 32 unit intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

In the ninth aspect of the present invention, there is provided a printing apparatus that performs printing on a printing medium using, for same base color, a printing agent of a first coloring material concentration and a printing agent of a second coloring material concentration lower than the first color material concentration, based on printing data generated based on an image signal, wherein for a range of variations in image signal values, printing is performed so that an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

With the above configuration, for a range of variations in signal values of image signals, which range corresponds to a variation of color from white, through a color having a maximum saturation or a maximum density of a predetermined color, to black, both a printing agent of a first coloring material concentration and a printing agent of a second coloring material concentration lower than the first color material concentration are used in connection with a signal value for the color having the maximum saturation or the maximum density of the predetermined color. This prevents a total applying rate of a printing agent used for printing from decreasing rapidly near a maximum saturation or a maximum density point, compared to the use of only the printing agent of first coloring material concentration.

Further, for a range of variations in signal values of image signals, with 10 of 32 intervals into which is divided the range corresponding to a variations of color from white, through a color having a maximum saturation or a maximum density of a predetermined color, to black, a distribution of the applying rate of a printing agent of a second color material concentration lower than a first color material density concentration is changed from a maximum of the applying rate to zero, and with 10 unit intervals, the total applying rate of printing agents used has a smaller change rate than that of the applying rate of a printing agent of the second color material concentration. Thereby, the applying rate distribution of the printing agent of the second color material concentration varies relatively gently from its maximum value to zero with the 10 unit intervals. Furthermore, with the range from its maximum value to zero, the total applying rate varies more gently than the gently varying applying rate of the printing agent of the second coloring material concentration.

Furthermore, for a range of variations in signal values of image signals, with N/2 or more of N (an integer equal to or larger than 2) unit intervals into which is divided the range corresponding to a variation of color from white, through a color having a maximum saturation or a maximum density of a predetermined color, to black, the applying rate of a printing agent of a second coloring material concentration lower than a first coloring material concentration varies from zero through a maximum value thereof back to zero, and for variation range of a signal value in which the applying rate distribution of the printing agent of the second coloring material concentration varies from a maximum value thereof to zero, the total applying rate of printing agent used has a smaller change rate than that of the applying rate of the print agent of the second color material density. Thereby, the printing agent of the second coloring material concentration can be used with half or more of the total range of the signal value. Furthermore, with this range, the total applying rate varies more gently than that of the applying rate of the printing agent of the second coloring material concentration.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below with reference to the drawings.

Figure 3:
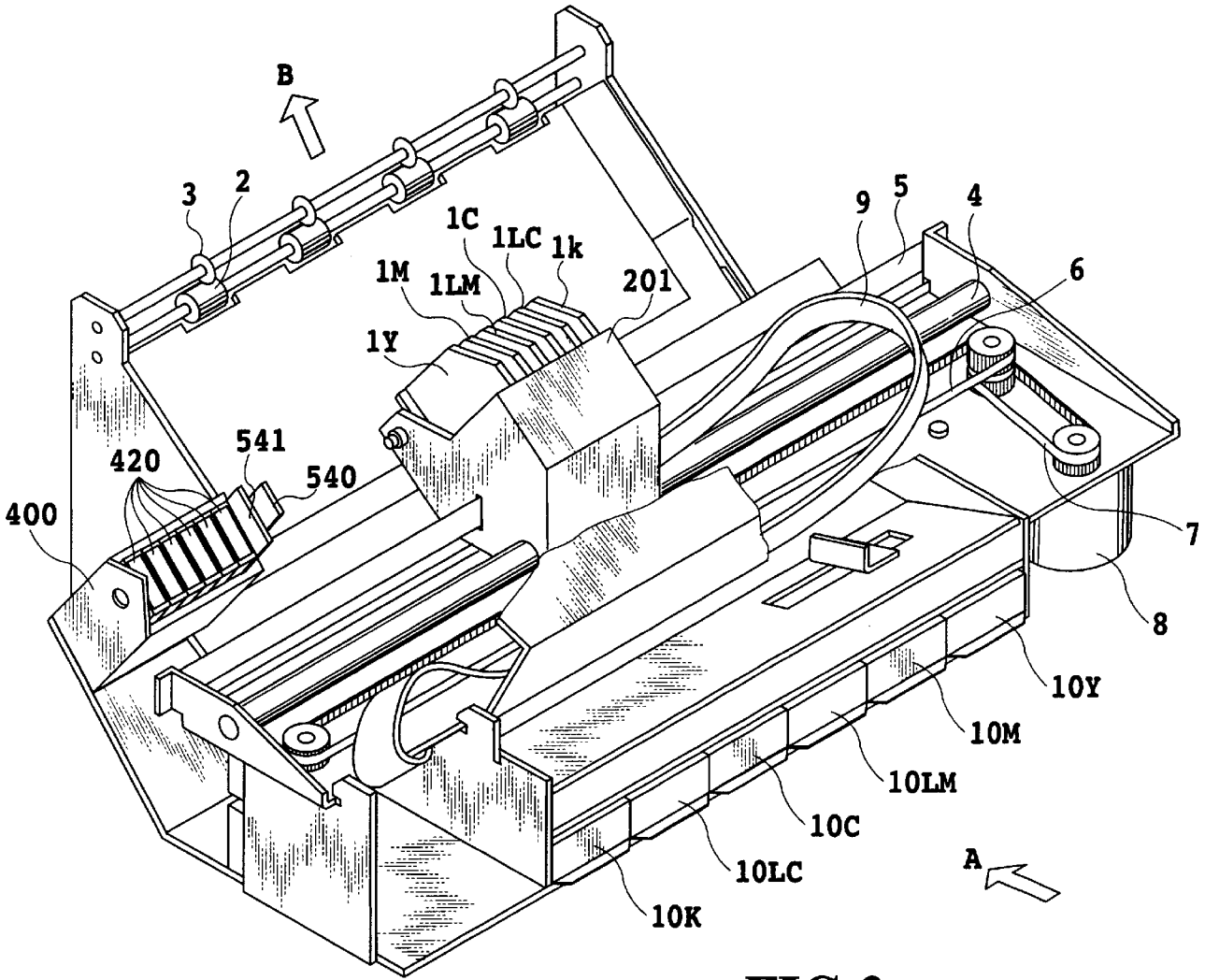
FIG. 3 is a perspective view showing an ink jet printer according to an embodiment of the present invention.

FIG. 3 is a perspective view showing an ink jet printer according to an embodiment of the present invention.

A printer according to this embodiment, shown in the figure, performs printing using six types of inks including black (K), light cyan (LC), dark cyan (C), light magenta (LM), dark magenta (M), and yellow (Y). That is, printing heads 1K, 1LC, 1C, 1LM, 1M, and 1Y are used for the respective inks. These printing heads are mounted in a carriage 201 so as to be arranged in a direction in which the carriage is moved. The printing heads can be individually installed in and removed from the carriage. Each printing head has a plurality of ink ejection openings through which ink can be ejected on the basis of ejection data obtained by image processing according to the present invention, described later in FIG. 5, 6 or 7. The carriage 201 in which the printing heads are mounted can be moved by being guided along a guide shaft 4. The carriage connects to a part of a belt 6 passed around pulleys located at the opposite ends of the movement range of the carriage 201. Accordingly, driving force from a carriage motor 8 can be transmitted to the carriage 201 for movement. Thus, the six types of printing heads can scan a fed printing medium. During this scanning, the ink can be ejected on the basis of the ejection data to form ink dots on the printing medium so as to print an image or the like. The printing heads and an electric circuit in the printer main body are electrically connected thorough a cable 9. Thus, the electric circuit in the printer main body can transfer an ejection signal and a control signal to the printing heads.

Ink cassettes 10K, 10LC, 10C, 10LM, 10M, and 10Y store black, light cyan, cyan, dark magenta, magenta, and yellow inks, respectively, to supply these inks to the corresponding printing heads via ink supply passages (not shown).

Movement of the carriage 201 is detected by an encoder having an encoder scale 5. This allows the scanning speed and position of the carriage 201 to be detected to control movement of the printing heads and ejection timings. A recovery unit 400 is provided near one end of the movement range of the carriage 201. The recovery unit 400 performs various operations in order to allow the printing heads to always eject the ink properly. While the printer is not executing a printing operation, the carriage 201 moves to the position of the recovery unit 400. This allows caps 420 of the unit 400 to perform a capping operation of covering the corresponding printing heads. The position at which the carriage 201 is located opposite the recovery unit 400 is referred to as a "home position" (hereinafter referred to as an "HP"). The caps 420 of the recovery unit 400 are used not only for capping but also for preliminary ejection, i.e. ejection from the printing heads which is not associated with printing. The preliminary ejection enables ink with increased viscosity in the printing heads, notably inside the ejection opening to be discharged, thereby preventing a decrease in ejection performance. Ink discharged into the caps by the preliminary ejection is sucked by a recovery pump (not shown) and discharged into a waste ink tank. The preliminary ejection is carried out a predetermined timing such as timing after the start of printing or timing at the start of printing. In the printer of this embodiment, the carriage moves to the HP for preliminary ejection in both unidirectional and bi-directional printing.

The printing medium is fed by rollers or the like driven by a sheet feeding motor (not shown). The printing medium is fed in a direction shown by an arrow A in the figure. Once the printing medium reaches a position at which it is printed by the printing heads, it is fed by a predetermined amount for each scanning operation of the printing heads. Thus, an image or the like is printed all over the printing medium.

Subsequently, the printing medium is discharged in the direction shown by an arrow B in the figure, using discharge rollers similarly rotated by driving force from the sheet feeding motor as well as spurs 3.

The dark and light cyan inks have cyan colors of similar base color or hue as well as different color material concentrations; the dark and light magenta inks have magenta colors of similar base color or hue as well as different color material concentrations. The dark color ink has a higher coloring material concentration relative to a solvent than the light color ink. Further, dots of the dark color ink have a higher optical density than dots of the light color ink. In this embodiment, the coloring material is a dye, which may be replaced with a pigment. The difference between the dark and light color inks may include not only a difference in concentration between the coloring materials but also a difference in coloring material itself. Further, the composition of the solvent in the ink may differ between the dark and light color inks. Furthermore, in this embodiment, the six types of inks are used. However, seven types of inks may be used, including light yellow ink having a lower density than yellow ink.

Further, in this embodiment, the printing heads for the six types of inks are arranged in the scanning direction. Thus, the respective lines of ejection openings in the respective printing heads are also arranged in the scanning direction. Alternatively, the printing heads may have a vertical arrangement in which the ejection opening lines, through which the different types of inks are ejected, are arranged in a direction orthogonal to the scanning direction of the printing heads, i.e. a direction in which the print medium is fed. In this case, the printing heads have integrated ejection opening lines through which different types of inks are otherwise ejected. The vertical arrangement enables ejection opening lines for a plurality of ink colors to be arranged in a smaller space than the system in which the printing heads are arranged in the scanning direction. Thus, advantageously, the apparatus can be miniaturized. Further, the order in which the respective color inks are ejected remains unchanged during a bi-directional printing operation. Consequently, printed colors can be suppressed to be varied in the bi-directional printing.

Figure 4:
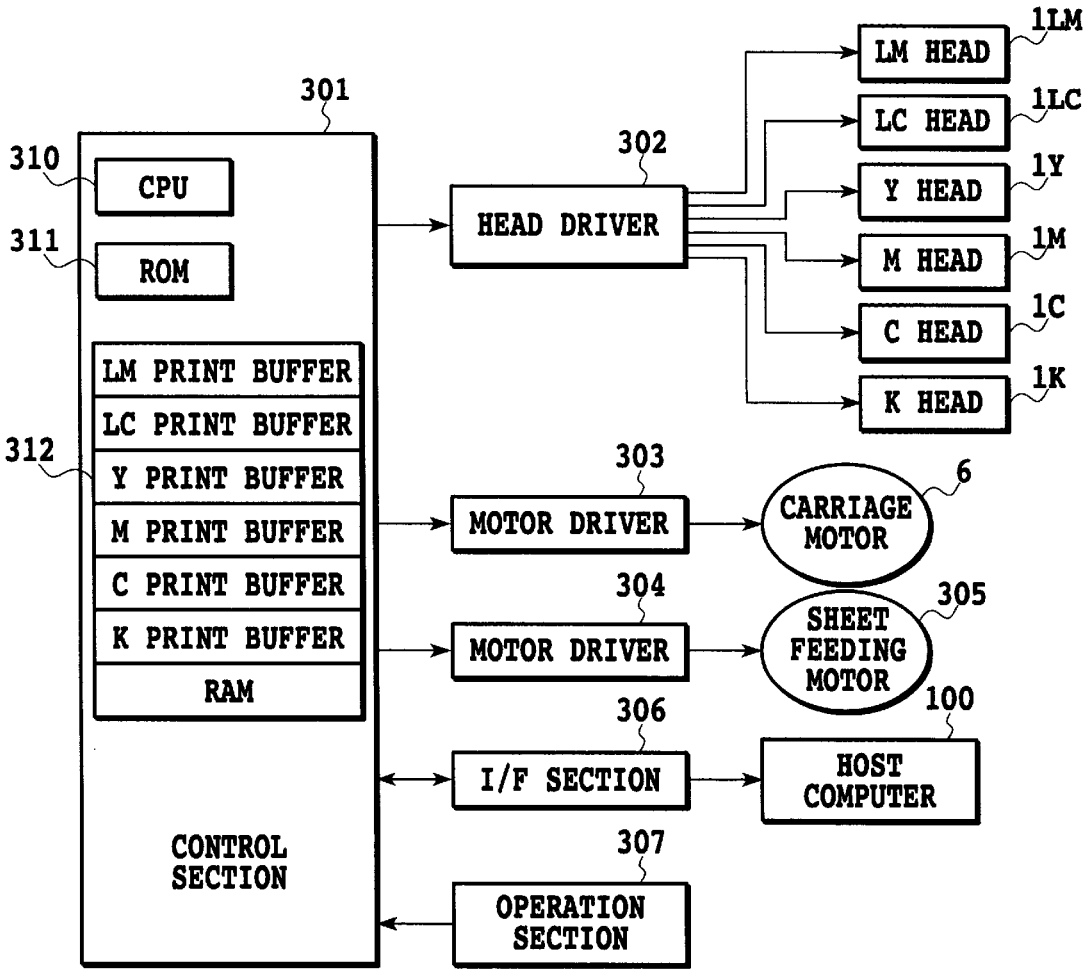
FIG. 4 is a block diagram showing a control configuration in the printer shown in FIG. 3 and the configuration of a printing system composed of this printer and a host computer.

FIG. 4 is a block diagram showing a control configuration in the printer shown in FIG. 3 as well as the configuration of a printing system composed of this printer and a host computer.

In the figure, reference numeral 301 denotes a control section structured by comprising an electric circuit of the above-described printer. The control section executes an operation control and data processing for the printer to control printing on the basis of printing data and the like from the host computer 100. More specifically, the control section 301 is provided with a CPU 310 in a microprocessor form, a ROM 311 that stores control programs and various data executed by the CPU 310, a RAM 312 which is used as a work area when the CPU 310 executes various processes and which temporarily retains various data for controlling printing.

Figure 1:
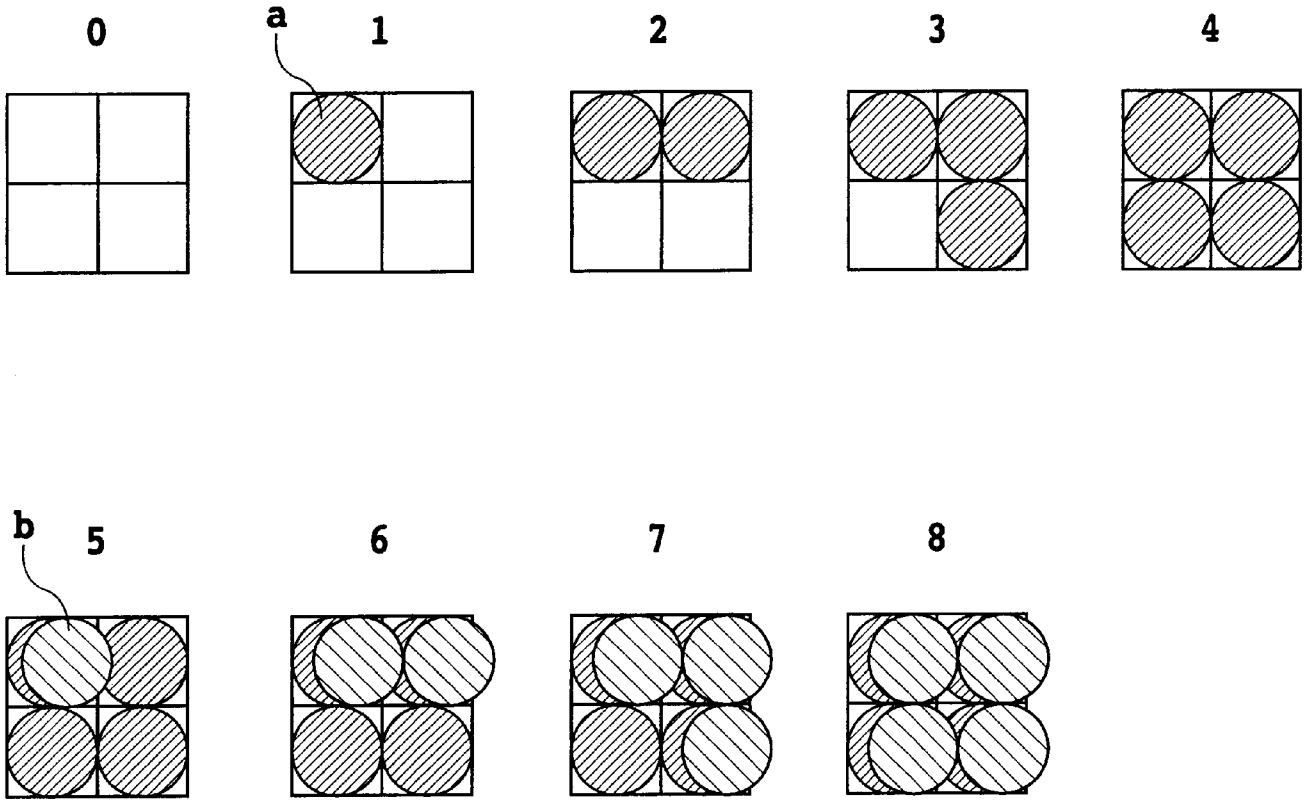
FIG. 1 is a diagram showing an ink dot arrangement pattern (index pattern) for density data for each pixel to describe applying rates of ink.

The RAM 312 is provided with a receive buffer that temporarily stores printing data received from the host computer 100, and a print buffer that stores ejection data for the printing heads 1K, 1C, 1LC, 1M, 1LM, and 1Y. The ejection data are obtained by transporting printing data transmitted from the host computer 100 as the index data described in FIG. 1 into ejection data for each ejection opening in each printing head according to an index pattern.

Reference numeral 302 denotes a head driver that drives the dark cyan ink printing head 1C, the dark magenta ink printing head 1M, the yellow ink printing head 1Y, the black ink printing head 1K, the light cyan ink printing head 1LC, and the light magenta ink printing head 1LM to eject the corresponding ink from the respective heads. Further, reference numerals 303 and 304 denote motor drivers that drive the carriage driving motor 8 and a sheet feeding motor 305, respectively, according to control signals from the control section 301. Reference numeral 303 denotes an operation section comprising various keys operated by a user and a display such as an LCD. Reference numeral 306 denotes an interface section that controls an interface between the printer and the host computer 100.

The host computer 100 creates image information such as characters and images using various application programs, and uses a printer driver to execute image processing, described later in FIG. 5, in order to cause the printer to print the image information.

A printing system is constituted to include the printer and host computer described above.

Figure 5:
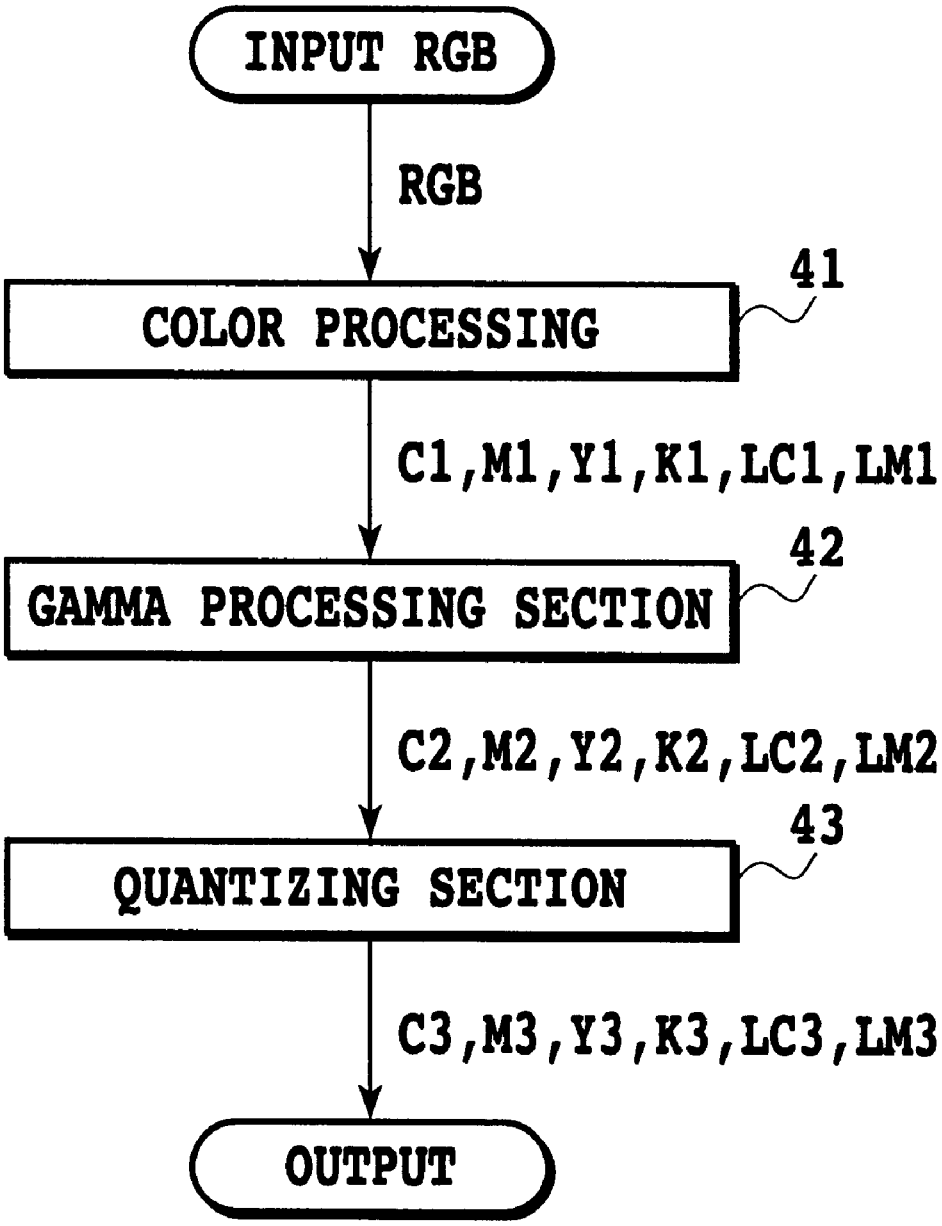
FIG. 5 is a block diagram showing a configuration for image processing executed by a printer driver in the host computer 100 shown in FIG. 4.

FIG. 5 is a block diagram showing a configuration for image processing executed by the printer driver in the host computer 100. This processing creates print data for the printer. The print data are transmitted to the printer and input thereto via the interface section 306 as described above. This image process may be executed by the printer. In this case, of course, the form the data and the like are adapted for the processing in the printer.

An original image signal which is composed of R, G, and B signals each consisting of 8 bits and which is read by a scanner or created by an application as described above is converted into 8-bit density signal values (gradation values) corresponding to the respective six types of inks used in the printer by a color processing section 41. That is, in this embodiment, the signals R, G, and B are converted into density signals C1, M1, Y1, K1, LC1, and LM1 corresponding to dark cyan, dark magenta, yellow, black, light cyan, and light magenta. FIG. 5 omits illustrating a processing of compressing a color reproduction range to adapt a reproduction range for the signals R, G, and B to the color reproduction range of the printer for describing a maximum saturation or a maximum density according to the present invention in an easy-to-understand manner. In an actual process, the color reproduction range is compressed to provide signals R, G, and B. Then, the maximum saturation or the maximum density defined by these signals R, G, and B is processed as described later in FIG. 6 or 7. Further, it also may be said that FIG. 5 shows a configuration corresponding to an aspect in which the range of colors that can be reproduced by the printer (and a printing medium used) without executing the above compressing process. This processing configuration is used to print images to which saturation or density is important, notably graphic images or the like when such process is executed, the total ink applying rate, described in FIG. 2, often decreases rapidly.

Furthermore, a gamma (γ) correcting section 42 executes a gamma correction to obtain corrected 8-bit density signals C2, M2, Y2, K2, LC2, and LM2. The gamma correction is a process of making corrections such that print densities realized by the printer have a linear relationship with density signals obtained from the color processing section 41, considering the relationship between the density signals and the actual print densities in the printer.

A process of determining ink applying rates used to represent colors provided in the form of signals R, G, and B, which is described later in FIGS. 6 and 7 as first and second embodiments, respectively, is executed as a color signal converting process obtained by synthesizing the process executed by the color processing section 41 (and the compressing process, executed before this process) and the process executed by the gamma correcting section 42. More specifically, a three-dimensional table is used which contains a conversion relationship obtained by synthesizing conversion relationships used in the processes executed by the color processing section 41 and the gamma correcting section 42, and is referenced by the signals R, G, and B. The density signals C2, M2, Y2, K2, LC2, and LM2 obtained as outputs from the table correspond to the applying rates described in FIG. 6 or 7.

Once the density signals C2, M2, Y2, K2, LC2, and LM2 have been obtained as described above, a quantizing section 43 executes a quantizing process. In this embodiment, the 8-bit density signals are converted into index data C3, M3, Y3, K3, LC3, and LM3 that can each assume one of nine values. These index data are transmitted to the printer via the interface. According to their values, the index data are converted into ejection data that enable dots to be arranged in the pattern shown in FIG. 1. A method for quantization used by the quantizing section 43 is, for example, a dither method. This method carries out quantization using a predetermined dither pattern having different thresholds for the density signals for the respective pixels.

<First Embodiment>

Description will be given of a first embodiment of a method of determining ink applying rates for the printing system according to one embodiment of the present invention described above.

Figure 2:
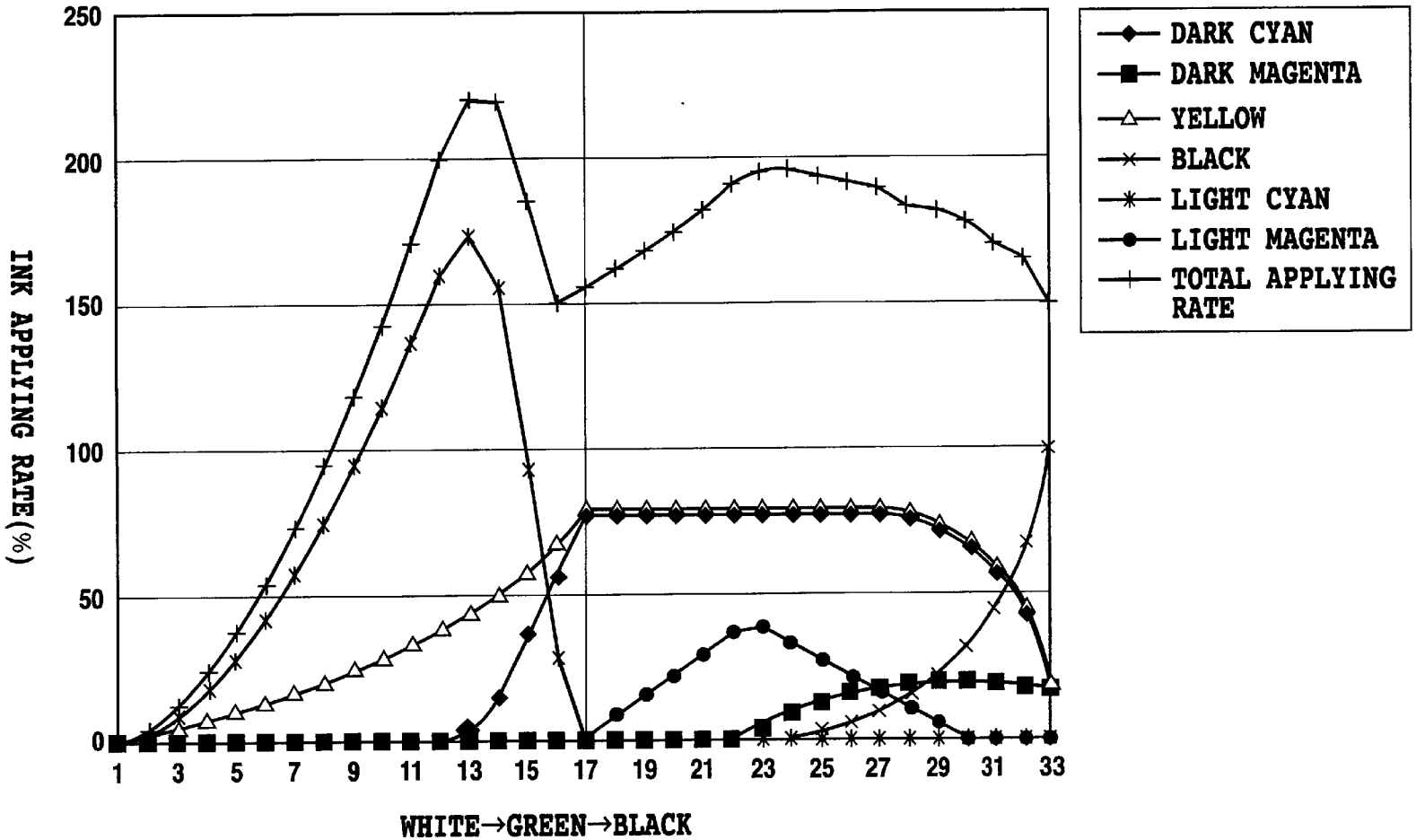
FIG. 2 is a graph showing a conventional example of the ink applying rates.
Figure 6:
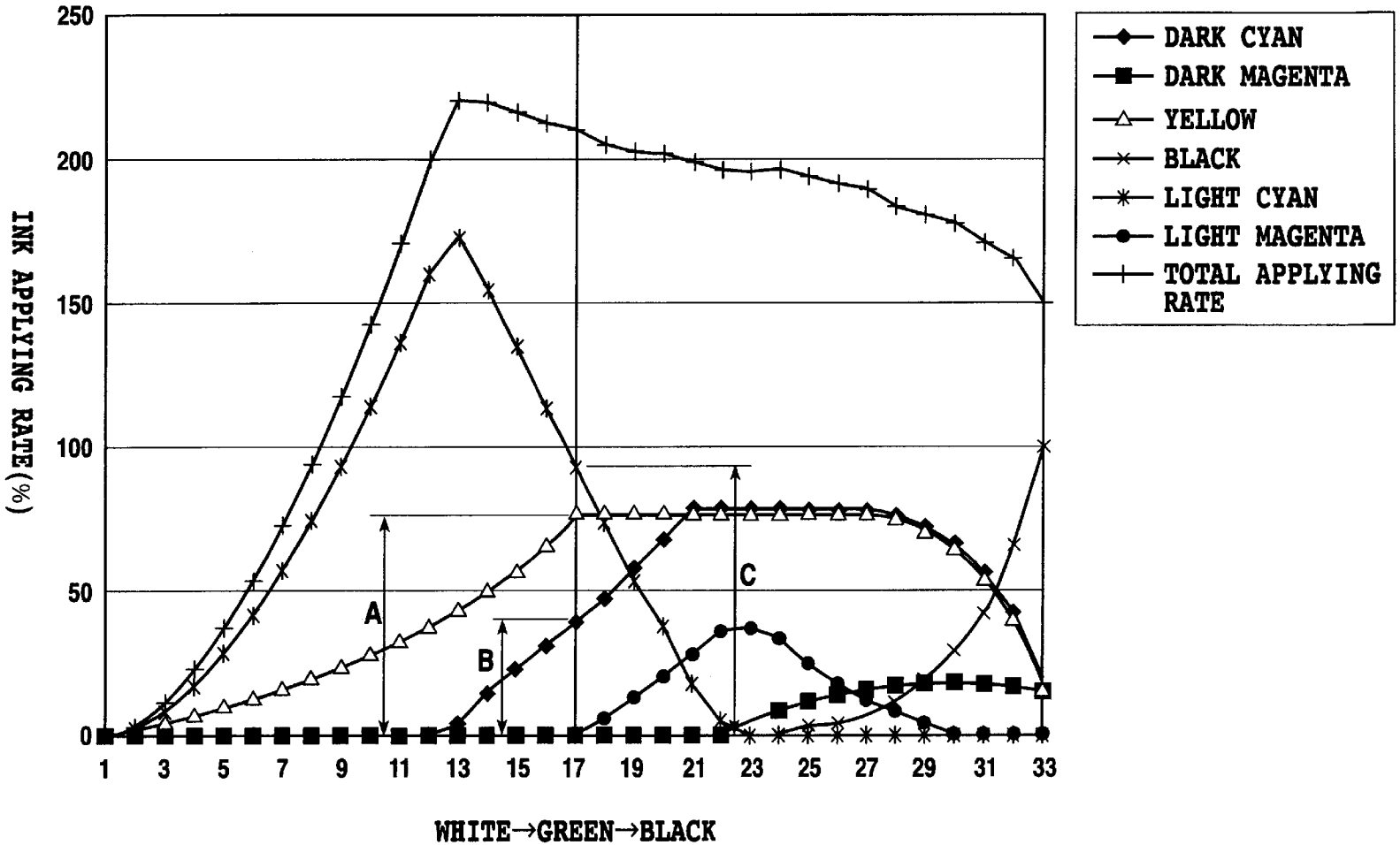
FIG. 6 is a graph illustrating how to determine ink applying rates according to a first embodiment of the present invention.

FIG. 6 is a graph illustrating how to determine ink applying rates according to the first embodiment. FIG. 6 is similar figure to FIG. 2 for the conventional example. That is, as with FIG. 2, FIG. 6 shows the applying rates of six types of inks including black (K), light cyan (LC), dark cyan (C), light magenta (LM), dark magenta (M), and yellow (Y) that are used when the printer represents a color varying from white through green to black (a variation in density) depending on variations in R, G, and B signals.

In this embodiment, at a point 17 with signal values (R=0, G=255, B=0) indicative of the maximum saturation of green, the light cyan ink is also used in addition to the dark cyan ink. The light cyan ink is not conventionally used at the point 17 with the maximum saturation or the maximum density. In contrast, in this embodiment, the light cyan ink is continuously used until signal values shown at a point 23 are reached. This prevents the total applying rate from decreasing rapidly near the point with the maximum saturation.

In the following description, the maximum saturation is substantially equal to the maximum density. Of course, strictly speaking, these values are different. However, it is evident from the description that the following embodiment relating to the maximum saturation is directly applicable to a case of the maximum density.

In following that the light cyan ink is used with the dark cyan ink, the amount of dark cyan ink used is reduced compared to the prior art. This is because the use of the light cyan ink reduces the amount of dark cyan ink required to obtain the required density of cyan in considering gradation or the like. In FIG. 6, reference sign B denotes the applying rate of the dark cyan ink at the maximum saturation point, indicating that this value is lower than the corresponding value in the prior art, shown in FIG. 2. Further, reference sign C approximately denotes the amount of light cyan ink at the same point. On the other hand, reference sign A denotes the applying rate used when the maximum saturation is achieved using only the dark cyan ink. These relationships indicate that the amount C of light color ink used must meet the condition C>A−B because the dark color ink has a higher coloring material concentration than the light color ink and because the light color ink must compensate for the decrease in amount of dark color ink.

By determining the ink applying rates as described above, the applying rate of the light cyan ink is prevented from decreasing rapidly, thereby preventing the total ink applying rate from decreasing rapidly. This prevents a decrease in dot density or a variation in density which may be caused by a rapid change in ink applying rate.

In connection with the prevention of a rapid change in applying rate of the light cyan ink as described above, in the conventional example in FIG. 2, the number on the horizontal axis varies over four different levels while the applying rate of the light cyan ink varies from its maximum value to zero. In contrast, in this embodiment, the number varies over ten levels. Thus, variations in signal values when the applying rate of the light cyan ink varies from its maximum value to zero is 2.5 times as large as those in the conventional example shown in FIG. 2. Consequently, the applying rate varies more gently.

Since the applying rate of the light cyan ink varies gently, the resulting variation in total applying rate is very gentle with the range from number 14 to number 16 on the horizontal axis compared to the same range of the conventional example shown in FIG. 2.

In other words, with 10 of 32 intervals into which is divided the range of variations in R, G, and B signal values corresponding to a variation of color from white through the maximum saturation (maximum density) to black, the applying rate of the light cyan ink varies from its maximum value to zero, and the total applying rate has a smaller change rate than that of the applying rate of the light cyan ink. In other words, the applying rate of the light cyan ink requires 17 or more unit intervals to vary from zero through its maximum value back to zero, and with the range of variations in signal values corresponding to a variation in the applying rate of the light cyan ink from its maximum value to zero, the total applying rate has a smaller change rate than that of the applying rate of the light cyan ink.

In this embodiment, the ink applying rates have been described in connection with secondary color green. However, for 1. secondary color red obtained using the dark magenta and yellow inks, 2. secondary color blue obtained using the dark magenta and dark cyan inks, 3. primary color magenta obtained using the dark magenta ink, and 4. primary color cyan obtained using the dark cyan ink, similar effects are produced by using 1. the light magenta ink at the maximum saturation point of red (maximum density point; R=255, G=0, B=0), 2. the light magenta and light cyan inks at the maximum saturation point of blue (maximum density point; R=0, G=0, B=255), 3. the light magenta ink at the maximum saturation point of magenta (maximum density point; R=255, G=0, B=255), and 4. the light cyan ink at the maximum saturation point of cyan (maximum density point; R=0, G=255, B=255). Furthermore, similar effects are produced for hues between the above five hues (green, red, blue, magenta, and cyan) and yellow.

Thus, the table for a process obtained by synthesizing the color processing 41 and the gamma correction 42 shown in FIG. 5 can have its contents determined so that the total applying rate does not vary rapidly, considering the distributions of the ink applying rates of the above colors and other colors having similar ink applying rate tendencies.

This prevents an area factor from decreasing rapidly with the certain range of signal values at least for colors for which the total ink applying rate varies rapidly in the prior art as described above.

<Second Embodiment>

Figure 7:
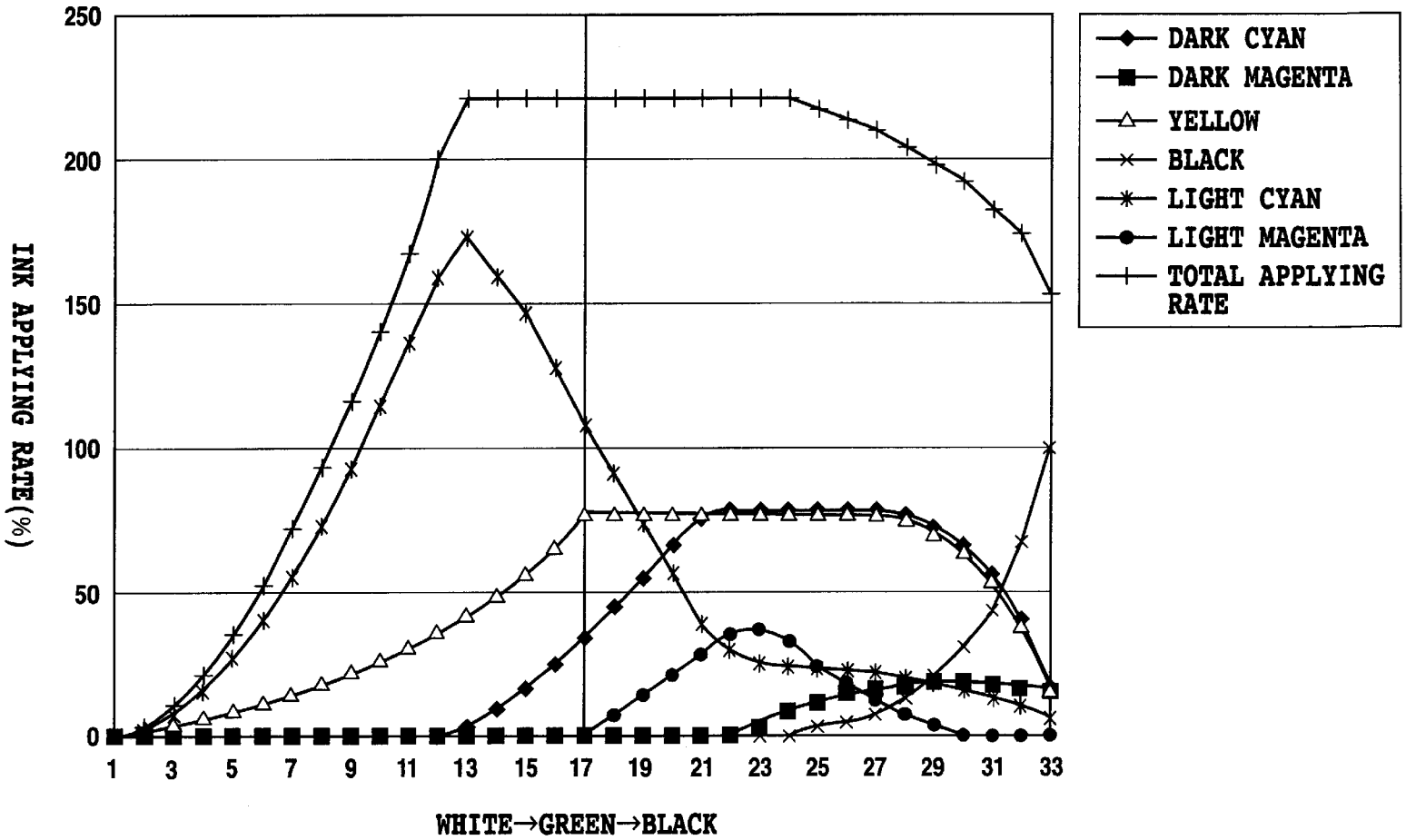
FIG. 7 is a graph illustrating how to determine ink applying rates according to a second embodiment of the present invention.

FIG. 7 is similar to FIG. 6 and illustrates how to determine the ink applying rates according to a second embodiment of the present invention.

This embodiment relates to an example in which light color ink is used over the entire range of variations in signal values. In general, since light color ink has a lower concentration than corresponding dark color ink, even if the light color ink is used with the same amount of the dark color ink, the density is not expected to increase significantly compared to the use of the dark color ink. Further, in an area in which lightness and saturation decreases from the maximum saturation point such as the range from number 17 to number 33 on the horizontal axis in FIG. 7, color development is unnoticeable in spite of the use of the light color ink because the image appears dark. Thus, the light color ink is used to adjust the total applying rate on the basis of its characteristic that it has a lower concentration or is unlikely to contribute color development.

In the example shown in FIG. 7, the light cyan ink is used to minimize a variation in the total applying rate, as in the example shown in FIG. 6, described above. The light cyan ink can also be used at and after number 23 on the horizontal axis in FIG. 7 to hinder the total applying rate from varying with the range from number 13 to number 24.

In this embodiment, the total applying rate is not varied till number 24 on the horizontal axis in FIG. 7. However, it is evident from the above description that the total applying rate can be set so as not to vary with signal values obtained at and after number 25, by using a larger amount of light cyan or light magenta inks at and after number 23.

<Other Embodiments>

The present invention is applicable to an apparatus composed of plural pieces of equipment (e.g. a host computer, interface equipment, a reader, a printer, and the like) or to an apparatus composed of one piece of equipment (e.g. a copier and a facsimile machine).

Further, the present invention is also accomplished by supplying program codes of software for implementing the functions of the embodiments shown in FIGS. 5, 6, and 7, described above, to a computer in an apparatus or system connected to various devices to operate them so as to implement these functions, and operating the various devices according to programs stored in the computer (CPU or MPU) of the system or apparatus.

Furthermore, in this case, the program codes of the software implement the functions of the embodiments described previously. The present invention is constituted by the program codes themselves and means for supplying the program codes to the computer, e.g. a storage medium storing the program codes.

The storage medium storing the program codes may be, for example, a floppy (registered trade mark) disk, a hard disk, an optical disk, a photomagnetic disk, a CD-ROM, a magnetic tape, a non-volatile memory card, or a ROM.

Further, it goes without saying that if the functions of the embodiments described previously are implemented not only by the computer by executing supplied program codes but also by the program codes by cooperating with an OS (Operating System) operating in the computer or another application or the like, these program codes are included in the embodiments of the present invention.

Furthermore, it should be appreciated that the present invention is also accomplished by storing supplied program codes in a memory installed in an expanded board in a computer or an expanded unit connected to the computer and then causing a CPU or the like provided in the expanded board or unit to execute a part or all of the actual process on the basis of instructions in the program codes, to implement the functions of the embodiments described previously.

As described above, according to the embodiments of the present invention, for a range of variations in signal values of image signals, which range corresponds to a variation of color from white, through a color having a maximum saturation or a maximum density of a predetermined color, to black, both a printing agent of a first coloring material concentration and a printing agent of a second coloring material concentration lower than the first color material concentration are used in connection with a signal value for the color having the maximum saturation or the maximum density of the predetermined color. This prevents a total applying rate of a printing agent used for printing from decreasing rapidly near a maximum saturation or a maximum density point, compared to the use of only the printing agent of first coloring material concentration.

Further, for a range of variations in signal values of image signals, with 10 of 32 intervals into which is divided the range corresponding to a variations of color from white, through a color having a maximum saturation or a maximum density of a predetermined color, to black, a distribution of the applying rate of a printing agent of a second color material concentration lower than a first color material density concentration is changed from a maximum of the applying rate to zero, and with 10 unit intervals, the total applying rate of printing agents used has a smaller change rate than that of the applying rate of a printing agent of the second color material concentration. Thereby, the applying rate distribution of the printing agent of the second color material concentration varies relatively gently from its maximum value to zero with the 10 unit intervals. Furthermore, with the range from its maximum value to zero, the total applying rate varies more gently than the gently varying applying rate of the printing agent of the second coloring material concentration.

Furthermore, for a range of variations in signal values of image signals, with N/2 or more of N (an integer equal to or larger than 2) unit intervals into which is divided the range corresponding to a variation of color from white, through a color having a maximum saturation or a maximum density of a predetermined color, to black, the applying rate of a printing agent of a second coloring material concentration lower than a first coloring material concentration varies from zero through a maximum value thereof back to zero, and for variation range of a signal value in which the applying rate distribution of the printing agent of the second coloring material concentration varies from a maximum value thereof to zero, the total applying rate of printing agent used has a smaller change rate than that of the applying rate of the print agent of the second color material density. Thereby, the printing agent of the second coloring material concentration can be used with half or more of the total range of the signal value. Furthermore, with this range, the total applying rate varies more gently than that of the applying rate of the printing agent of the second coloring material concentration.

As a result, print density in a part of a printed image can be prevented from decreasing rapidly due to rapidly change of a total applying rate and then printing with appropriately reproducing density can be performed.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An image processing method for generating printing data based on an image signal, the printing data being used for a printing apparatus that performs printing on a printing medium using, for a same base color, a printing agent of a first coloring material concentration and a printing agent of a second coloring material concentration lower than said first color material concentration, said method comprising the step of:

generating printing data such that for a range of variations in image signal values corresponding to a variation of color from white, through a maximum saturation or a maximum density of a predetermined color, to black, both the printing agent of the first coloring material concentration and the printing agent of the second coloring material concentration are used for the signal values of the maximum saturation or the maximum density of the predetermined color.

2. An image processing method as claimed in claim 1, wherein printing data are generated so that the printing agent of the second coloring material concentration is used over the entire range of variations in image signal values.

3. An image processing method as claimed in claim 1, wherein a cyan, magenta, yellow, and black printing agents are used, and of these printing agents, at least a dark cyan or a dark magenta printing agent corresponds to the printing agent of the first coloring material concentration, and at least a light cyan or a light magenta printing agent corresponds to the printing agent of the second coloring material concentration.

4. An image processing method as claimed in claim 1, wherein when an applying rate for the printing medium is defined as A in a case that only the printing agent of the first coloring material concentration is used for the signal values of the color having the maximum saturation or the maximum density, the applying rate B of the printing agent of the first coloring material concentration and the applying rate C of the printing agent of the second coloring material concentration have a relationship:

$$C>A-B$$

when both the printing agent of the first coloring material concentration and said printing agent of the second coloring material concentration are used for the signal values of the color having the maximum saturation or the maximum density.

5. An image processing method as claimed in claim 1, wherein the printing agent includes ink.

6. An image processing method as claimed in claim 1, wherein said step of generating printing data generates printing data that uses dark cyan, light cyan, and yellow printing agents for the signal value of the maximum saturation of a green color, when the predetermined color is the green color.

7. An image processing method as claimed in claim 1, wherein said step of generating printing data generates printing data that uses dark magenta, light magenta, and yellow printing agents for the signal value of the maximum saturation of a red color, when the predetermined color is the red color.

8. An image processing method as claimed in claim 1, wherein said step of generating printing data generates printing data that uses dark cyan, light magenta, dark magenta and light magenta printing agents for the signal value of the maximum saturation of a blue color, when the predetermined color is the blue color.

9. An image processing method as claimed in claim 1, wherein said step of generating printing data generates printing data that uses dark cyan and light cyan printing agents for the signal value of the maximum saturation of a cyan color, when the predetermined color is the cyan color.

10. An image processing method as claimed in claim 1, wherein said step of generating printing data generates printing data that uses dark magenta and light magenta printing agents for the signal value of the maximum saturation of a magenta color, when the predetermined color is the magenta color.

11. An image processing method for generating printing data based on an image signal, the printing data being used for a printing apparatus that performs printing on a printing medium using, for a same base color, a printing agent of a first coloring material concentration and a printing agent of a second coloring material concentration lower than said first color material concentration, said method comprising the step of:

generating printing data such that for a range of variation in image signal values, a distribution of an applying rate of the printing agent of the second coloring material concentration varies from a maximum value thereof to zero with 10 of 32 unit intervals into which is divided the range of variations corresponding to a variation of color from white, through a maximum saturation or a maximum density of a predetermined color, to black, and for the 10 unit intervals, a total applying rate of printing agents used has a smaller change rate than that of the applying rate of the printing agent of the second coloring material concentration.

12. An image processing method for generating printing data based on an image signal, the printing data being used for a printing apparatus that performs printing on a printing medium using, for a same base color, a printing agent of a first coloring material concentration and a printing agent of a second coloring material concentration lower than said first color material concentration, said method comprising the step of:

generating printing data such that for a range of variations in image signal values, an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

13. A printing system including a printing apparatus that performs printing on a printing medium using, for a same base color, a printing agent of a first coloring material concentration and a printing agent of a second coloring material concentration lower than said first color material concentration and an image processing apparatus for generating printing data used in the printing apparatus based on an image signal, wherein the image processing apparatus generates the printing data so that for a range of variations in image signal values corresponding to a variation of color from white, through a color having a maximum saturation or a maximum density of a predetermined color, to black, both the printing agent of the first coloring material concentration and the printing agent of the second coloring material concentration are used for the signal values of the color having the maximum saturation or the maximum density of the predetermined color.

14. A printing system as claimed in claim 13, wherein printing data are generated so that the printing agent of the second coloring material concentration is used over the entire range of variations in image signal values.

15. A printing system as claimed in claim 13, wherein a cyan, magenta, yellow, and black printing agents are used, and of these printing agents, at least a dark cyan or a dark magenta printing agent corresponds to the printing agent of the first coloring material concentration, and at least a light cyan or a light magenta printing agent corresponds to the printing agent of the second coloring material concentration.

16. A printing system as claimed in claim 13, wherein when an applying rate for the printing medium is defined as A in a case that only the printing agent of the first coloring material concentration is used for the signal values of the color having the maximum saturation or the maximum density, the applying rate B of the printing agent of the first coloring material concentration and the applying rate C of the printing agent of the second coloring material concentration have a relationship:

$$C>A-B$$

when both the printing agent of the first coloring material concentration and said printing agent of the second coloring material concentration are used for the signal values of the color having the maximum saturation or the maximum density.

17. A printing system as claimed in claim 13, wherein the printing agent includes ink.

18. A printing system including a printing apparatus that performs printing on a printing medium using, for a same base color, a printing agent of a first coloring material concentration and a printing agent of a second coloring material concentration lower than said first color material concentration and an image processing apparatus for generating printing data used in the printing apparatus based on an image signal, wherein the image processing apparatus generates the printing data so that for a range of variation in image signal values, the distribution of an applying rate of the printing agent of the second coloring material concentration varies from a maximum value thereof to zero with 10 of 32 unit intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

19. A printing system including a printing apparatus that performs printing on a printing medium using, for a same base color, a printing agent of a first coloring material concentration and a printing agent of a second coloring material concentration lower than said first color material concentration and an image processing apparatus for generating printing data used in the printing apparatus based on an image signal, wherein the image processing apparatus generates the printing data so that for a range of variations in image signal values, an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

20. A printing apparatus that performs printing on a printing medium using, for a same base color, a printing agent of a first coloring material concentration and a printing agent of a second coloring material concentration lower than said first color material concentration, based on printing data generated based on an image signal, wherein based on the printing data generated for a range of variations in image signal values corresponding to a variation of color from white, through a color having a maximum saturation or a maximum density of a predetermined color, to black, both the printing agent of the first coloring material concentration and the printing agent of the second coloring material concentration are used for printing the color having the maximum saturation or the maximum density of the predetermined color.

21. A printing apparatus as claimed in claim 20, wherein printing data are generated so that the printing agent of the second coloring material concentration is used over the entire range of variations in image signal values.

22. A printing apparatus as claimed in claim 20, wherein a cyan, magenta, yellow, and black printing agents are used, and of these printing agents, at least a dark cyan or a dark magenta printing agent corresponds to the printing agent of the first coloring material concentration, and at least a light cyan or a light magenta printing agent corresponds to the printing agent of the second coloring material concentration.

23. A printing apparatus as claimed in claim 20, wherein when an applying rate for the printing medium is defined as A in a case that only the printing agent of the first coloring material concentration is used for the signal values of the color having the maximum saturation or the maximum density, the applying rate B of the printing agent of the first coloring material concentration and the applying rate C of the printing agent of the second coloring material concentration have a relationship:

$$C>A-B$$

when both the printing agent of the first coloring material concentration and said printing agent of the second coloring material concentration are used for the signal values of the color having the maximum saturation or the maximum density.

24. A printing apparatus as claimed in claim 20, wherein the printing agent includes ink.

25. A printing apparatus that performs printing on a printing medium using, for a same base color, a printing agent of a first coloring material concentration and a printing agent of a second coloring material concentration lower than said first color material concentration, based on printing data generated based on an image signal, wherein for a range of variation in image signal values, printing is performed so that the distribution of an applying rate of the printing agent of the second coloring material concentration varies from a maximum value thereof to zero with 10 of 32 unit intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

26. A printing apparatus that performs printing on a printing medium using, for a same base color, a printing agent of a first coloring material concentration and a printing agent of a second coloring material concentration lower than said first color material concentration, based on printing data generated based on an image signal, wherein for a range of variations in image signal values, printing is performed so that an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

27. An image processing program that is read by a computer for executing a processing for generating printing data based on an image signal, the printing data being used for a printing apparatus that performs printing on a printing medium using, for a same base color, a printing agent of a first coloring material concentration and a printing agent of a second coloring material concentration lower than said first color material concentration, wherein for a range of variations in image signal values corresponding to a variation of color from white, through a color having a maximum saturation or a maximum density of a predetermined color, to black, printing data are generated so that both the printing agent of the first coloring material concentration and the printing agent of the second coloring material concentration are used for the signal values of the color having the maximum saturation or the maximum density of the predetermined color.

28. An image processing program that is read by a computer for executing a processing for generating printing data based on an image signal, the printing data being used for a printing apparatus that performs printing on a printing medium using, for a same base color, a printing agent of a first coloring material concentration and a printing agent of a second coloring material concentration lower than said first color material concentration, wherein for a range of variation in image signal values, printing data are generated so that the distribution of an applying rate of the printing agent of the second coloring material concentration varies from a maximum value thereof to zero with 10 of 32 unit intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

29. An image processing program that is read by a computer for executing a processing for generating printing data based on an image signal, the printing data being used for a printing apparatus that performs printing on a printing medium using, for a same base color, a printing agent of a first coloring material concentration and a printing agent of a second coloring material concentration lower than said first color material concentration, wherein for a range of variations in image signal values, printing data are generated so that an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

30. A storage medium storing an image processing program readably by an information processing apparatus, the program being for generating printing data based on an image signal, the printing data being used for a printing apparatus that performs printing on a printing medium using, for a same base color, a printing agent of a first coloring material concentration and a printing agent of a second coloring material concentration lower than said first color material concentration, wherein for a range of variations in image signal values corresponding to a variation of color from white, through a color having a maximum saturation or a maximum density of a predetermined color, to black, the program generates the printing data so that both the printing agent of the first coloring material concentration and the printing agent of the second coloring material concentration are used for the signal values of the color having the maximum saturation or the maximum density of the predetermined color.

31. A storage medium storing an image processing program readably by an information processing apparatus, the program being for generating printing data based on an image signal, the printing data being used for a printing apparatus that performs printing on a printing medium using, for a same base color, a printing agent of a first coloring material concentration and a printing agent of a second coloring material concentration lower than said first color material concentration, wherein for a range of variation in image signal values, the program generates the printing data so that the distribution of an applying rate of the printing agent of the second coloring material concentration varies from a maximum value thereof to zero with 10 of 32 unit intervals into which is divided the range of variations corresponding to a variation of color from white, through a color having a maximum saturation or a maximum density of a predetermined color, to black, and for the 10 unit intervals, a total applying rate of printing agents used has a smaller change rate than that of the applying rate of the printing agent of the second coloring material concentration.

32. A storage medium storing an image processing program readably by an information processing apparatus, the program being for generating printing data based on an image signal, the printing data being used for a printing apparatus that performs printing on a printing medium using, for a same base color, a printing agent of a first coloring material concentration and a printing agent of a second coloring material concentration lower than said first color material concentration, wherein for a range of variations in image signal values, the program generates the printing data so that an applying rate of the printing agent of the second coloring material concentration varies from zero through a maximum value thereof back to zero with N/2 or more of N (an integer equal to or larger than 2) unit intervals into which is divided the range of variations corresponding to a variation of color from white, through a color having a maximum saturation or a maximum density of a predetermined color, to black, and for the range of variations in signal values with which range the applying rate distribution of the printing agent of the second coloring material concentration varies from a maximum value thereof to zero, a total applying rate of printing agents used has a smaller change rate than that of the applying rate of the printing agent of the second coloring material concentration.

33. An image processing method for generating printing data based on an image signal, the printing data being used for a printing apparatus that performs printing on a printing medium using, for a same base color, a printing agent of a first color material concentration and a printing agent of a second coloring material concentration lower than said first color material concentration, the method comprising:

generating printing data such that for a range of variations in image signal values corresponding to a variation of color from white, through a maximum saturation of a predetermined hue, to black, both the printing agent of the first coloring material concentration and the printing agent of the second coloring material concentration are used for the signal values of the maximum saturation of the predetermined hue.

34. An image processing method for generating printing data based on an image signal, the printing data being used for a printing apparatus that performs printing on a printing medium using, for a same base color, a printing agent of a first color material concentration and a printing agent of a second coloring material concentration lower than said first color material concentration, the method comprising:

generating printing data such that for a range of variations in image signal values corresponding to a variation of color from white, through a maximum saturation or a maximum density of a predetermined secondary color, to black, both the printing agent of the first coloring material concentration and the printing agent of the second coloring material concentration are used for the signal values of the maximum saturation or the maximum density of the predetermined secondary color.

35. An image processing method for generating printing data based on an image signal, the printing data being used for a printing apparatus that performs printing on a printing medium using, for a same base color, a printing agent of a first color material concentration and a printing agent of a second coloring material concentration lower than said first color material concentration, the method comprising:

generating printing data such that for a range of variations in image signal values corresponding to a variation of color from white, through a maximum saturation or a maximum density of a predetermined primary color, to black, both the printing agent of the first coloring material concentration and the printing agent of the second coloring material concentration are used for the signal values of the maximum saturation or the maximum density of the predetermined primary color.

36. An image processing method for generating printing data based on an image signal, the printing data being used for a printing apparatus that performs printing on a printing medium using, for a same base color, a printing agent of a first color material concentration and a printing agent of a second coloring material concentration lower than said first color material concentration, the method comprising:

generating printing data such that for a range of variations in image signal values corresponding to a variation of color from white, through a maximum saturation of a predetermined color, to black, both the printing agent of the first coloring material concentration and the printing agent of the second coloring material concentration are used for the signal values of the maximum saturation of the predetermined color.

* * * * *

UNITED STATES PATENT AND TRADEMARK OFFICE

CERTIFICATE OF CORRECTION

PATENT NO. : 6,749,284 B2
DATED : June 15, 2004
INVENTOR(S) : Shigeyasu Nagoshi et al.

It is certified that error appears in the above-identified patent and that said Letters Patent is hereby corrected as shown below:

Title page,
Item [57], ABSTRACT,
Line 10, “eaturation” should be -- saturation --.

Column 2,
Line 30, “denotes” should be -- denote --.

Column 3,
Line 18, “partly” should read -- a partial --.

Column 5,
Line 12, “of 32” should read -- of 32 unit --.

Column 6,
Line 63, “of 32” should read -- of 32 unit --.
Line 64, “a variations” should read -- variations --.

Column 8,
Line 25, “thorough” should read -- through --.

Column 10,
Line 56, “like when” should read -- like. When --.

Column 12,
Line 30, “of 32” should read -- of 32 unit --.

UNITED STATES PATENT AND TRADEMARK OFFICE

CERTIFICATE OF CORRECTION

PATENT NO. : 6,749,284 B2
DATED : June 15, 2004
INVENTOR(S) : Shigeyasu Nagoshi et al.

It is certified that error appears in the above-identified patent and that said Letters Patent is hereby corrected as shown below:

Column 14,
Line 23, “of 32” should read -- of 32 unit --.
Line 24, “a variations” should read -- variations --.
Line 62, “to rapidly” should read -- to rapid --.

Signed and Sealed this

Twenty-first Day of September, 2004

JON W. DUDAS
*Director of the United States Patent and Trademark Office*